US008669450B2

(12) United States Patent
Mohr

(10) Patent No.: US 8,669,450 B2
(45) Date of Patent: Mar. 11, 2014

(54) HANDBELL AND COATING METHOD

(75) Inventor: Derek Mohr, Pipersville, PA (US)

(73) Assignee: Malmark, Inc., Plumsteadville, PA (US)

( * ) Notice: Subject to any disclaimer, the term of this patent is extended or adjusted under 35 U.S.C. 154(b) by 75 days.

(21) Appl. No.: 13/236,829

(22) Filed: Sep. 20, 2011

(65) Prior Publication Data

US 2013/0068082 A1 Mar. 21, 2013

(51) Int. Cl.
*G10D 13/08* (2006.01)

(52) U.S. Cl.
USPC ..... 84/406

(58) Field of Classification Search
USPC ..... 84/402–410
See application file for complete search history.

(56) References Cited

U.S. PATENT DOCUMENTS 1,505,155 A 8/1924 Mackenzie et al.
2,650,886 A 9/1953 Zelley
2,787,929 A * 4/1957 Musser ..... 84/406
3,556,883 A 1/1971 Naito et al.
3,698,932 A 10/1972 Dean
3,982,055 A 9/1976 Howard
5,304,403 A 4/1994 Schlesinger et al.
5,492,772 A * 2/1996 Carey et al. ..... 428/648
6,245,435 B1 6/2001 O'Brien et al.
6,811,819 B2 11/2004 Joshi et al.
6,818,313 B2 11/2004 Phelps et al.
6,871,613 B2 3/2005 Murray et al.

* cited by examiner

*Primary Examiner* — Kimberly Lockett
(74) *Attorney, Agent, or Firm* — IP Works, PLLC

(57) ABSTRACT

A protective coating is applied to a bell body composed of bronze by simply dip-coating the bell with an outer layer of zinc. The process is carried out by immersing the bell body in a hot aqueous solution containing sodium hydroxide and powdered free zinc. After the bell is removed from the coating solution it is rinsed and then polished. The coating protects the bell from environmental contaminants without changing the frequency or musical quality of the bell and therefore may be used equally with newly manufactured or refurbished bells.

9 Claims, 1 Drawing Sheet

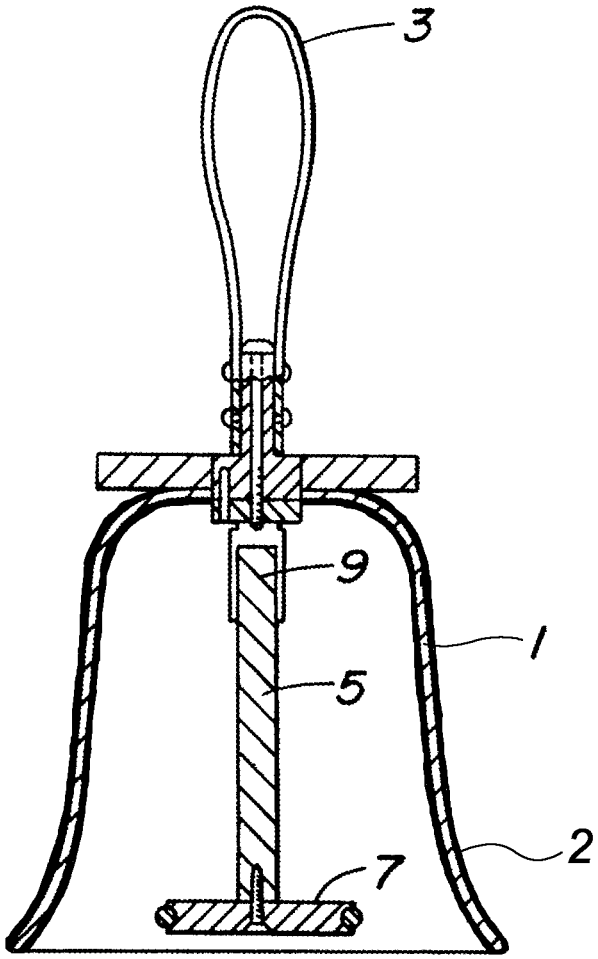
3
9
1
5
2
7

HANDBELL AND COATING METHOD

FIELD OF THE INVENTION

This invention relates to musical handbells and more specifically to applying a protective and decorative coating to the surface of the bell.

BACKGROUND OF THE INVENTION

Musical handbells are delicate musical instruments that need to be handled with care. The tonal qualities of the bell can be adversely affected by any contaminants that may adhere to the surface of the bell from handling. For this reason, handbell ringers often wear gloves so that their bare hands to not come in contact with the bell. Even though the bells are always handled to avoid tarnishing, nonetheless they need to be cleaned from time to time to remove oxidation and environmental pollutants.

In order to preserve the bells, it is known in the art to provide handbells with a tarnish-resistant coating such as disclosed in U.S. Pat. No. 6,871,613 issued to Murray et al. The coating disclosed in this document provides the surface of the bell with a vapor-deposited nitride layer such as zirconium nitride or titanium nitride. Temperatures at which the nitride layers are applied can range between 320° F. and 700° F. It is therefore a process which requires expensive equipment and skilled technicians to accomplish. Furthermore, according to the Murray patent, the added nitride layer will raise the frequency of the bell depending upon the thickness of the layer. This will require that tuned bells being refurbished will need to be retuned thus adding additional time and expense to the coating procedure.

There is a therefore a need in the art for a protective handbell coating that is easy to apply, will not affect the frequency or other tonal qualities of the bell, does not require a skilled craftsman to apply and which will provide a durable and decorative finish to the bell which will resist tarnishing.

SUMMARY OF THE INVENTION

In order to meet the needs in the art above, it is the object of the present invention to provide an extremely simple process for coating a handbell which does not change the frequency of the bell or adversely affect its musical qualities. As explained further herein, the present invention is carried out by the simple dip-coating of the bell body into a hot aqueous solution of sodium hydroxide and powdered free zinc dissolved in distilled water. The process is therefore simple, inexpensive and easy to be carried out by a worker without great technical skill Furthermore, there is no expensive specialized equipment needed. The present process has been shown to provide an extremely inexpensive and effective method of providing handbells with a protective coating. Furthermore, the present zinc coating provides a unique silvery decorative appearance to the bell, thus providing both aesthetic and functional attributes.

More specifically, the Applicant has invented a bell having a protective coating comprising a hollow bell body having an internal clapper for striking the body to produce a sound wherein the bell body is composed of bronze which is dip-coated with an outer layer of zinc by being immersed in a hot aqueous solution containing sodium hydroxide and powdered free zinc. The process for coating the bell is carried out by first starting with a bronze bell body composed of approximately 80% copper and 20% tin. The bell body is then immersed in a coating solution of distilled water, sodium hydroxide and powdered free zinc. The solution is maintained at a temperature of 200T and after approximately 2 to 3 minutes, when the zinc plating is observed, the bell body is removed from the coating solution. The ratio of the sodium hydroxide to powdered free zinc in the coating solution is approximately 5 to 1 by weight. In a specific formulation, 24 g of sodium hydroxide is combined with 5 g of zinc powder mixed in 100 ml of distilled water. After the bell is removed from the coating solution it is rinsed and then polished. The bell is then tuned to match the frequency of a note of the musical scale.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

BRIEF DESCRIPTION OF THE DRAWINGS

FIG. 1 is a front sectional view of a handbell of the present invention.

DESCRIPTION OF THE PREFERRED EMBODIMENT

Referring now to FIG. 1, a typical handbell employing the present invention includes a bell body 1 which begins as a metal casting. The casting is then machined to the precise size and shape which optimally produces the bell's fundamental note. Each bell has a handle 3 and a striking element such as clapper 7 within the bell affixed to a shaft 5 which pivots at joint 9 to sound the bell. A full range of handbells for playing by a handbell choir produces musical notes having fundamental frequencies between C8 and G1. Bells of this type are cast from a bronze alloy typically about 80% copper and 20% tin. As explained below, a coating 2 is applied to the bell body for its protective and aesthetic attributes. By polishing and other metal working processes, the bell is tuned to achieve the highest musical quality of their respective fundamental tonal frequencies.

In one embodiment of the invention, the process for coating the handbell body 1 is carried out as follows. First, 24 g of sodium hydroxide is dissolved in 100 ml of distilled water in a glass beaker or other glass vessel while stifling continuously. The solution is then heated to its boiling point after which the heat is lowered so that the solution is maintained at approximately 200 F. Next, 5 g of free zinc powder is added to the solution. The solution will begin to fizz as some of the zinc dissolves forming sodium zincate and giving off hydrogen. The bell is then polished before it is lowered into the hot solution containing the sodium zincate and any remaining undissolved zinc powder. Contact of the copper bell with the zinc solution draws the zincate ion ($ZnO_2^{2-}$) in solution to the surface of the bell. At the point of contact of the copper with the zincate ion, a chemical reaction occurs: the zincate ion is decomposed and reduced by hydrogen on the surface of the bell forming a coating of metallic zinc that is silvery in appearance. While the bell is immersed, a glass rod is used to stir up the powdered zinc. The bell is left immersed until observation reveals it is plated with a shiny coat of zinc. This will take about 2 to 3 minutes. The plated bell is then removed and rinsed in cold tap water to remove surface traces of sodium hydroxide and sodium zincate. In a final step, the bell is polished. The zinc sodium hydroxide solution may be reused for additional bells, and distilled water may be added to replace evaporate as needed.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A bell having a protective coating, comprising a hollow bell body having an internal clapper for striking the bell body to produce a sound; wherein said bell body is composed of bronze which is dip-coated with an outer layer of zinc, and wherein said zinc is applied to said bell body while immersed in a hot aqueous solution containing sodium hydroxide and powdered free zinc.

2. The bell of claim 1 wherein said bell is a handbell.

3. The bell of claim 2 wherein said handbell is tuned to match the frequency of a note on the musical scale.

4. The method of coating a bell comprising:

providing a bronze bell body composed of approximately 80% copper and 20% tin;

providing an aqueous coating solution of distilled water, sodium hydroxide and powdered free zinc;

immersing said bell body in said coating solution; and removing said bell body from said coating solution.

5. The method of claim 4 wherein said coating solution is maintained at a temperature of approximately 200° F.

6. The method of claim 5 wherein the ratio of sodium hydroxide to powdered free zinc in said coating solution is approximately 5 to 1 by weight.

7. The method of claim 6 wherein said sodium hydroxide and zinc powder are dissolved in distilled water according to the formula ratios of 24 g of sodium hydroxide, 5 g of zinc powder and 100 ml of distilled water.

8. The method of claim 7 further including the final steps of rinsing and then polishing the bell.

9. The method of claim 8 wherein said bell is a musical handbell tuned to match a frequency of a note on the musical scale.

* * * * *